United States Patent [19]

Taylor

[11] Patent Number: 4,769,590

[45] Date of Patent: Sep. 6, 1988

[54] DIFFERENTIAL LEVEL SHIFTER EMPLOYING CURRENT MIRROR

[75] Inventor: Keith A. Taylor, Portland, Oreg.

[73] Assignee: Tektronix, Inc., Beaverton, Oreg.

[21] Appl. No.: 115,026

[22] Filed: Nov. 2, 1987

[51] Int. Cl.[4] ..... G05F 3/16

[52] U.S. Cl. ..... 323/315; 323/316

[58] Field of Search ..... 323/315, 316, 317

[56] References Cited

U.S. PATENT DOCUMENTS

| | | | |
|---|---|---|---|
| 4,684,831 | 8/1987 | Kruast | 323/316 |
| 4,714,871 | 12/1987 | Craft et al. | 323/315 |
| 4,727,269 | 2/1988 | Luich | 323/316 |

*Primary Examiner*—Patrick R. Salce
*Assistant Examiner*—Jeffrey Starratt
*Attorney, Agent, or Firm*—Boulden G. Griffith

[57] ABSTRACT

A differential signal input is applied through two resistors to the two sides of a dual clamping circuit and the two current outputs of a current mirror. The dual clamping circuit prevents the voltage on either output of the current mirror from going above some reference value in response to the imbalance created by the differential input signal. With one side, the high side, of the differential signal output held to this reference value by the operation of the clamping transistor on that side, the whole voltage imbalance on the input appears on the other output as a result of the operation of the current mirror. Thus, the reference level of the differential signal is shifted at the output, while the amplitude of the signal is preserved. Alternative embodiments substitute a dual clamping circuit with an opposite polarity or an averaging circuit for the dual clamping circuit described, thereby referencing the output signal to the low side or an average instead of the high side as in the preferred embodiment.

14 Claims, 2 Drawing Sheets

DIFFERENTIAL LEVEL SHIFTER EMPLOYING CURRENT MIRROR

BACKGROUND OF THE INVENTION

The present invention relates generally to the field of differential signal transmission, and more particularly to circuits that shift the reference level of a differential signal without affecting its amplitude.

Previously, a variety of methods have been used to shift the level of differential signals without affecting the signal amplitude. Most of these methods require either discrete components or numerous components, or consume too much power, or are difficult to implement in bipolar integrated circuitry. For example, many of these methods utilize operational amplifiers circuits, and these would require too many components, draw too much power for the environment available, and need capacitors larger than those available.

What is desired is a means for shifting the level of a differential signal without affecting its amplitude that requires few components, does not consume much power, and is easily implemented in bipolar integrated circuit technology.

SUMMARY OF THE INVENTION

The present invention is a differential level shifter that employs a current mirror and either a dual clamping circuit or an averaging circuit to shift the reference level of a differential signal while preserving its amplitude.

The two sides of the input differential signal are applied through two resistors to the two sides of a dual clamping circuit and the two outputs of a current mirror. The dual clamping circuit prevents the voltage on either output of the current mirror from going above some reference value in response to the imbalance created by the differential input signal. With one side, the high side, of the differential signal output held to this reference value by the operation of the clamping transistor on that side, the whole voltage imbalance on the input appears on the other output as a result of the operation of the current mirror. Thus, the reference level of the differential signal is shifted to a lower level at the output, while the amplitude of the signal is preserved.

DESCRIPTION OF THE PREFERRED EMBODIMENT

Figures 1, 4:
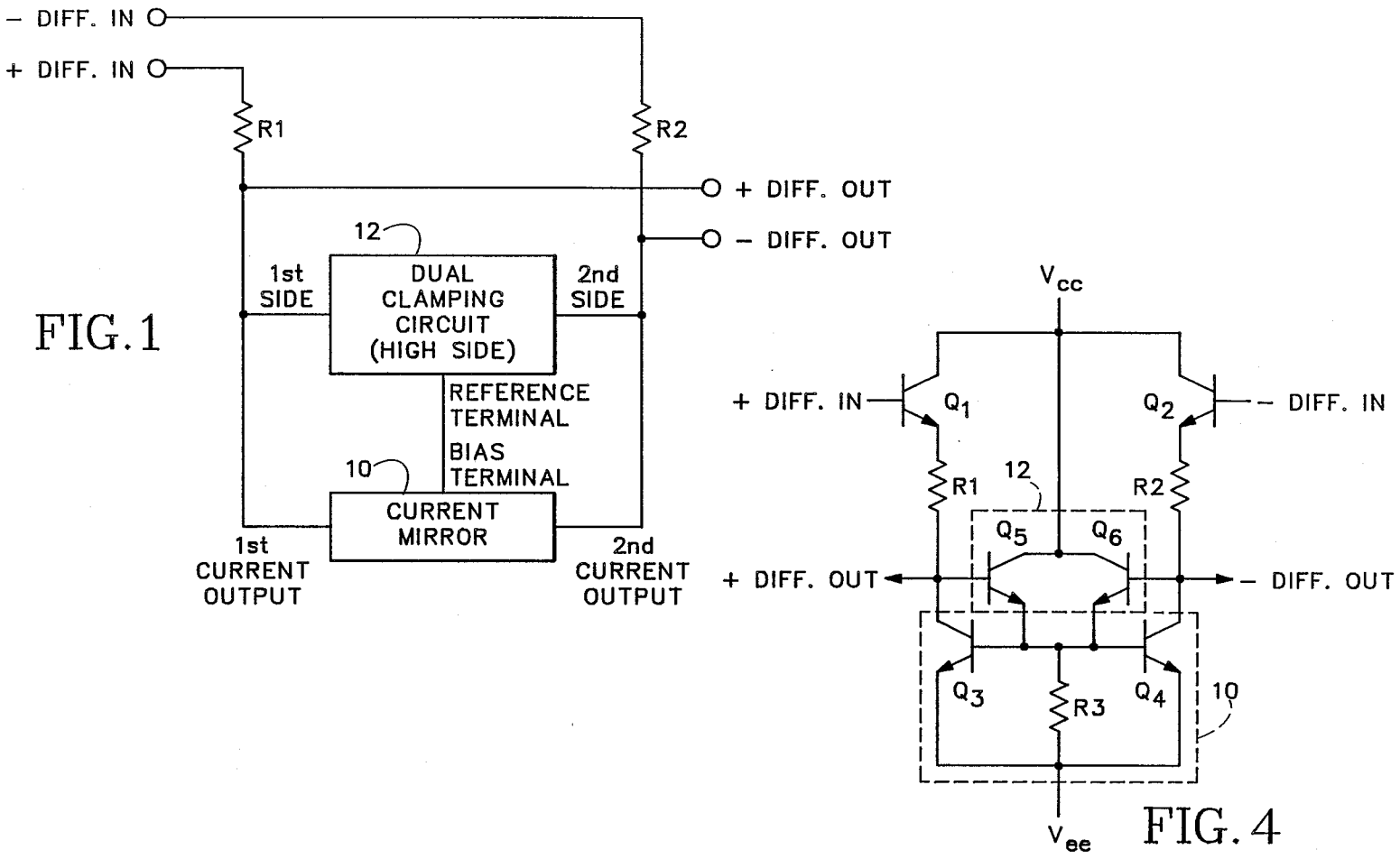
FIG. 1 is a block diagram of the invention, with a dual clamping circuit operating on the high side of the signal out.
FIG. 4 is schematic diagram of the preferred embodiment of the invention, using a dual clamping circuit operating on the high side of the signal out.

Referring now to FIG. 1, a differential input signal appearing across + DIFF IN and − DIFF IN is applied through two resistors R1,R2 to the two outputs of a current mirror 10 and the two sides of a dual camping circuit 12, these nodes where the respective current mirror outputs and dual clamping circuit terminals meet also being the outut terminals + DIFF OUT and − DIFF OUT. The dual clamping circuit 12 prevents the voltage on either output of these output terminals + DIFF OUT and − DIFF OUT from going above a predetermined reference value. With the highest voltage on the output clamped to this reference value, the voltage decrease on the low side of the differential input signal in conjunction with the operation of the current mirror 10 causes the voltage on the other output to change by an amount corresponding to the total voltage difference across the input. Thus, the reference level of the differential signal appearing at the output + DIFF OUT and − DIFF OUT is shifted, while the amplitude of this output signal is the same as that of the output.

Figure 2:
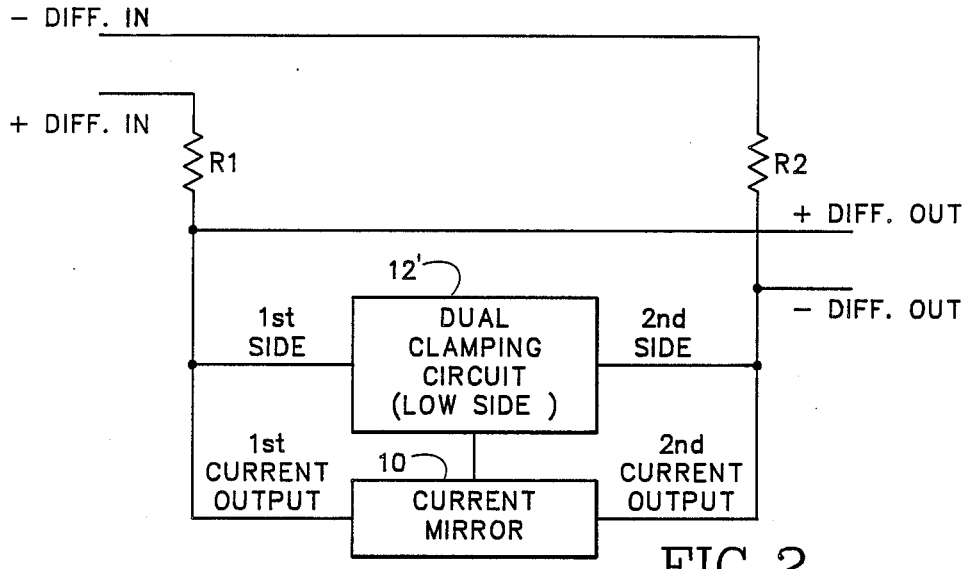
FIG. 2 is a block diagram of the invention, with a dual clamping circuit operating on the low side of the signal out.

In an alternative embodiment, shown in FIG. 2, the dual clamping circuit 12' has the opposite polarity and operates to prevent the voltage on either side of the current mirror 10 from going below a reference value in response to the lower voltage on one side of the differential input signal. In this embodiment, the other output still changes by an amount that corresponds to the total voltage difference on the input, but now these changes are positive-going excursions from a relatively negative reference level, rather than negative-going excursions from a relatively positive reference level as in the first embodiment.

Figure 3:
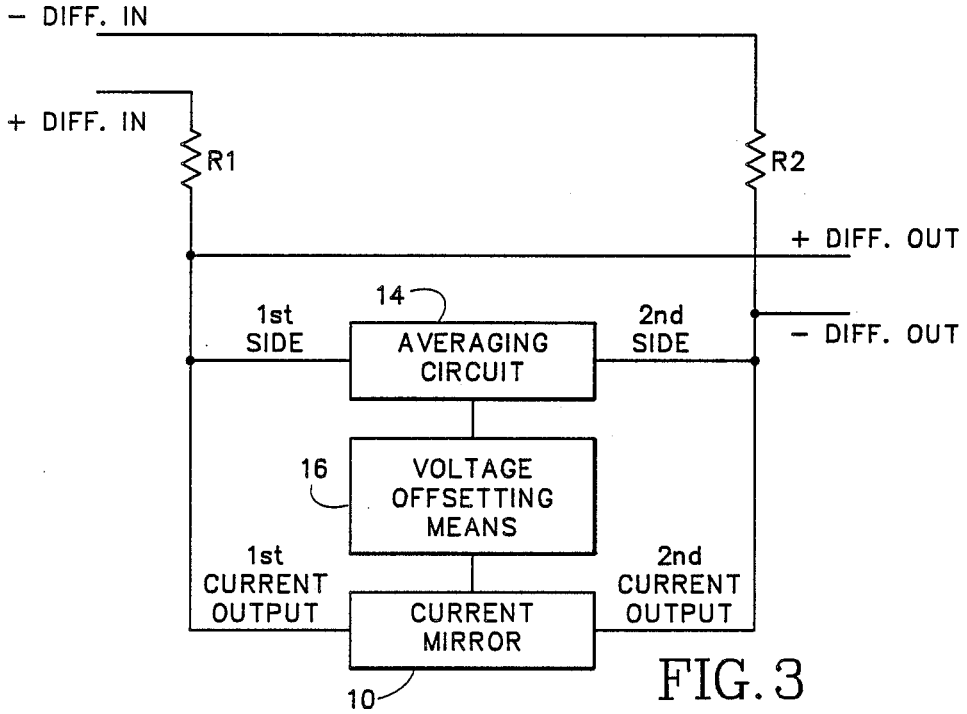
FIG. 3 is a block diagram of the invention, using an averaging circuit and a voltage offsetting means.

In yet another embodiment, shown in FIG. 3, an averaging circuit 14 is substituted for the dual clamping circuit (10 in FIG. 1). In this version of the circuit, the outputs are positive- and negative-going excursions from an intermediate reference level that is the average of the two signal inputs.

Optionally, a voltage offsetting means 16 further shifts the reference level of the output signal, as shown in FIG. 3. This alternative is also, with proper design considerations, optionally combinable with either version of the dual clamping circuits shown in FIGS. 1 and 2.

Referring now to FIG. 4, a schematic diagram of the preferred embodiment of the invention shown in FIG. 1, a pair of matched emitter follower transistors Q1,Q2 transmit the differential signal input from their bases to their emitters, applying it to resistors R1,R2, respectively. The other ends of these equal resistors R1,R2 are connected to the collectors of a matched pair of current mirror transistors Q3,Q4 and to the bases of another pair of matched transistors, dual clamping transistors Q5,Q6. The bases of the current mirror transistors Q3,Q4 and the emitters of the dual clamping transistors Q5,Q6 are all coupled to Vee via a bias resistor R3. The emitters of the current mirror transistors are connected directly to Vee.

To analyze the operation of this circuit, let us suppose that, starting from an initial condition of no differential input, a differential voltage of two small increments is applied to the input terminals. When this occurs, the voltage on the emitter of transistor Q1 goes up by one increment, while the voltage on the emitter of transistor Q2 goes down by one increment. The increase in voltage at the top of the resistor R1 does not produce any change in the voltage at the other end, the output terminal + DIFF OUT, because the voltage at that point is held to a constant value of two base-emitter drops by clamping transistor Q5 and current mirror transistor Q3. Therefore, the voltage across resistor R1 has to increase by one increment.

As the voltage across resistor R1 increases by this one increment, so does the voltage across resistor R2. This occurs because these resistors have an equal value and are being supplied with equal currents due to the operation of current mirror 10. As long as at least one of the clamping transistors Q5,Q6 is conducting. the bias on the current mirror 10 is constant and it produces equal currents at both of its outputs. Thus, the voltage across resistor R2 increases by the same one increment that the voltage across resistor R1 changed.

However, because the negative side of the differential signal input is going low as the positive side is going high, the voltage at the top (Q2 end) of resistor R2 is decreasing by one increment at the same time that the voltage across it is increasing by one increment. The result is a total voltage change at the bottom of resistor R2 (− DIFF OUT) of two voltage increments, the same amount as the total differential signal input. However, now this signal amplitude is relative to a different reference voltage level, with this level established by the combined base-emitter drops of one of the dual clamping transistors and one of the current mirror transistors.

This circuit will only accurately replicate signals on its output whose differential amplitudes are less than the value that the clamping circuit clamps to. In this particular embodiment, that voltage limit is equal to two base-emitter drops. As this value is approached, the voltage on the collector of one of the current mirror transistors approaches Vee, forward biasing the collector-base junction of that transistor and preventing proper operation. To operate properly, this circuit also requires input levels at the emitters of emitter follower transistors Q1,Q2 that are above the reference level of the output, since this version of this circuit (as opposed to some of the alternative embodiments discussed below) shifts the reference level downward.

While the embodiment of the invention described in detail above is most suitable for some applications, it should be apparent that the inventive concept described above and claimed below is not limited to this implementation and that many variations can be made without departing from the spirit of the invention. In particular, other types of current mirrors could be substituted for the one shown, and the output reference level could be set to differing values by alternative choices for the dual clamping circuit, or the inclusion of a means for further offsetting the voltage (as shown in FIG. 3). The possibilities also include the use of a dual clamping circuit with a reversed polarity (as shown in FIG. 2), to provide an output signal with positive excursions relative to the reference voltage level. Alternatively, an averaging circuit can be substituted for the dual clamping circuit (as shown in FIG. 3), so as to reference the output to an average level rather than the higher or lower value of the input signal.

I claim:

1. A circuit for shifting the reference level of a differential signal while preserving its amplitude, comprising:

a first and second resistor, each having a first end and a second end, with the first end of each resistor coupled respectively to a first and second input terminal for receiving the differential signal to be level shifted;

a current mirror having a first current output, a second current output, and a bias terminal, with the first current output coupled to the second end of the first resistor to form a first output terminal, and with the second current output coupled to the second end of the second resistor to form a second output terminal; and a dual clamping circuit having a first side, a second side, and a reference terminal, with the first side coupled to the first output terminal, the second side coupled to the second output terminal, and the reference terminal coupled to the bias terminal of the current mirror.

2. A circuit as recited in claim 1, wherein the dual clamping circuit prevents voltages higher than a particular reference value.

3. A circuit as recited in claim 2 wherein the first and second resistors are of equal value and the first and second current outputs of the current mirror come from sub-circuits within the current mirror that have matching component values.

4. A circuit as recited in claim 2, further comprising means for inserting a constant voltage offset between the reference terminal of the dual clamping circuit and the bias terminal of the current mirror.

5. A circuit as recited in claim 4 wherein the first and second resistors are of equal value and the first and second current outputs of the current mirror come from sub-circuits within the current mirror that have matching component values.

6. A circuit as recited in claim 1, wherein the dual clamping circuit prevents voltages lower that a particular reference value.

7. A circuit as recited in claim 6 wherein the first and second resistors are of equal value and the first and second current outputs of the current mirror come from sub-circuits within the current mirror that have matching component values.

8. A circuit as recited in claim 6, further comprising means for inserting a constant voltage offset between the reference terminal of the dual clamping circuit and the bias terminal of the current mirror.

9. A circuit as recited in claim 8 wherein the first and second resistors are of equal value and the first and second current outputs of the current mirror come from sub-circuits within the current mirror that have matching component values.

10. A circuit as recited in claim 1 wherein the first and second resistors are of equal value and the first and second current outputs of the current mirror come from sub-circuits within the current mirror that have matching component values.

11. A circuit for shifting the reference level of a differential signal while preserving its amplitude, comprising:

a first and second resistor, each having a first end and a second end, with the first end of each resistor coupled respectively to a first and second input terminal for receiving the differential signal to be level shifted;

a current mirror having a first current output, a second current output, and a bias terminal, with the first current output coupled to the second end of the first resistor to form a first output terminal, and with the second current output coupled to the second end of the second resistor to form a second output terminal; and an averaging circuit having a first averaging input, a second averaging input, and a reference terminal, with the first averaging input being coupled to the first output terminal, the second averaging input being coupled to the second output terminal, and the reference terminal coupled to the bias terminal of the current mirror.

12. A circuit as recited in claim 11 wherein the first and second resistors are of equal value and the first and second current outputs of the current mirror come from sub-circuits within the current mirror that have matching component values.

13. A circuit as recited in claim 11, further comprising means for inserting a constant voltage offset between the reference terminal of the averaging circuit and the bias terminal of the current mirror.

14. A circuit as recited in claim 13 wherein the first and second resistors are of equal value and the first and second current outputs of the current mirror come from sub-circuits within the current mirror that have matching component values.

* * * * *